United States Patent [19]

Hubbard

[11] Patent Number: 4,746,533

[45] Date of Patent: May 24, 1988

[54] PROCESS FOR COATING A METALLIC SURFACE WITH A VITREOUS ENAMEL

[75] Inventor: William A. Hubbard, Towson, Md.

[73] Assignee: Mobay Corporation, Pittsburgh, Pa.

[21] Appl. No.: 944,635

[22] Filed: Dec. 19, 1986

[51] Int. Cl.[4] ..... B05D 7/00; B05D 1/06; B05D 1/36; B05D 3/02

[52] U.S. Cl. ..... 427/27; 427/376.5; 427/409; 427/419.5

[58] Field of Search ..... 427/419.5, 409, 33, 427/27, 376.5

[56] References Cited

U.S. PATENT DOCUMENTS 3,696,498 10/1972 Leontaritis et al. ..... 427/419.5 X
3,706,124 12/1972 Leontaritis et al. ..... 427/419.5 X
3,906,125 9/1975 Uher ..... 427/330
4,221,824 9/1980 Leonard et al. ..... 427/27

*Primary Examiner*—Evan K. Lawrence
*Attorney, Agent, or Firm*—Gene Harsh; Joseph C. Gil; Lyndanne M. Whalen

[57] ABSTRACT

Metallic surfaces are coated with vitreous enamel by a process in which a cleaning pretreatment of the metal surface to remove surface oil is not required. An enamel-forming material is applied to metal surface coated with a polybutene as the surface oil. The thus-coated metal surface is fired at a temperature sufficiently high to cause the enamel-forming material to form a vitreous enamel coating. The preferred method for applying the enamel-forming material is electrostatic deposition.

6 Claims, No Drawings

PROCESS FOR COATING A METALLIC SURFACE WITH A VITREOUS ENAMEL

BACKGROUND OF THE INVENTION

The present invention relates to a process for coating a metallic surface with a vitreous enamel which process does not require pre-treatment of the metal surface.

Enamel coated metallic surfaces are commonly used in household appliances because of their durability, resistance to corrosion and pleasing appearance. In the production of enamel coated sheet metal, one of the major objectives is a smooth surface with no blistering or bubbling. In order to achieve this objective, it was believed that the metal surface to be coated must be scrupulously clean and that pre-treatment to promote adhesion of the enamel coating to the metal (i.e. acid etching and flashing with nickel) was necessary.

Frits and processing techniques which eliminate the need for etching and flashing have been developed (See e.g. U.S. Pat. No. 4,221,824). Cleaning, however, was still required because in forming the metal to be coated, the metal surface is generally covered with an oil. Removal of such oil is necessary because oils pyrolyze at temperatures lower than the fusion temperature for the enamel-forming material and leave a carbonaceous residue on the metal surface. This residue detrimentally affects the surface characteristics of the coated metal by causing blistering and bubbling. This cleaning has generally been accomplished by chemical methods which require alkali and soap solutions for removing grease and dirt and acid solutions for removing oxidized metal. Such cleaning requires close control and the use of chemicals or energy. Disposal problems as well as the labor and equipment required, necessarily increase production time and cost. It would therefore be advantageous to be able to eliminate the need for such cleaning pre-treatment in a manner which would not result in surface defects.

One approach to eliminating the need for cleaning the metal surface to be coated without sacrificing surface characteristics is disclosed in U.S. Pat. No. 3,906,125. In this patent, a process for treating sheet steel in which the steel is subjected to oxidation, reduction and decarburization before the enamel-forming material is applied is described. Cleaning of the steel to remove oil is unnecessary in this process if the enamel-forming material is applied immediately after the decarburization. Where such immediate use is not possible, the treated steel is given a temporary coating of oil which oil must be subsequently removed. Consequently, the cleaning step is avoided in this process only if the steel is subjected to more extensive pre-treatment and the enamelling operation is carried out immediately after milling. Since immediate use is generally not possible, this disclosed process does not provide a practical alternative to coating the metal surface with an oil.

SUMMARY OF THE INVENTION

It is an object of the present invention to provide a process for coating a metallic surface with a vitreous enamel in a manner such that the coated surface is free of surface defects.

It is another object of the present invention to provide a process for coating a metallic surface with a vitreous enamel in which the metal surface to be coated is not subjected to a cleaning pre-treatment.

It is a further object of the invention to provide a process for electrostatic powder deposition of vitreous enamels to a metal surface which has not been cleaned to remove the surface oil.

These and other objects which will be apparent to those skilled in the art are accomplished by applying an enamel-forming material to a metallic surface coated with a polybutene as the surface oil and firing the thus-coated surface to a temperature at which the enamel-forming material becomes a vitreous enamel.

DETAILED DESCRIPTION OF THE INVENTION

This invention relates to a process for coating a metallic surface with a vitreous enamel in which the metal to be coated need not be pretreated to clean the surface oil prior to application of the enamel-forming material. More particularly, this invention relates to an electrostatic powder spraying process for the coating of a metallic substrate.

In principle, the present invention may be carried out by applying any enamel-forming material to any metal substrate by any of the known techniques with any of the known compositions. However, the full benefit of reduced cost and production time due to the elimination of pre-treatment of the metal substrate are realized only when the process and/or enamel-forming material are such that flashing with nickel and etching are unnecessary.

The present invention makes coating a substrate with enamel by a simple two step process possible. More specifically, in this process the enamel-forming powder is simply applied to a fabricated part and the coated part is run through a conventional porcelain enamel furnace. The coating matures within a brief period (i.e. usually 10–15 minutes) depending upon the specific powder.

The metal surfaces which may be coated in accordance with the present invention include cold-rolled sheet steel plate (particularly steel having a carbon content of less than 0.2%), "Enameling Iron" (carbon content approx. 0.03%), extra low carbon steel (carbon content approx. 0.003%), hot rolled steel and cast iron.

The metal surface is coated with a light film of polybutene and then processed through stamping and drawing operations to complete fabrication. In some cases, e.g., where the Faraday cage effect is encountered, it may be advantageous to apply the polybutene again after drawing to promote adherence of the ceramic powder before the firing operation.

The polybutenes required in the practice of the present invention are any of the several thermoplastic isotactic (stereoregular) polymers of isobutene and polymers of butene-1 and butene-2. Isobutene-1 and butene-2 may be homopolymerized to various degrees in chains containing from 10 to 1000 units with the viscosity increasing as the molecular weight increases. Polybutenes are commercially available and are sold under designations such as Indopol L14 (light oils) and heavier oils such as Indopol H-1500 (both of which are products of Amoco Chemical Corp.), and Vistane (a trademark of Enjay Chemical Co.).

Enamel-forming frits which may be used to coat a metallic substrate that has not been pickled or subjected to flashing with nickel are disclosed for example in U.S. Pat. Nos. 2,828,218; 2,786,782; 4,265,929 and 4,221,824.

Particularly preferred enamel-forming materials and techniques for applying such frits are disclosed for example, in U.S. Pat. Nos. 3,928,668; 4,221,824 and 4,265,929 which are incorporated herein by reference. Among the known techniques, however, electrostatic deposition is preferred. Electrostatic deposition of the enamel-forming material in the form of a powder is preferred because problems such as rheological control, wet grinding, drying, etc. are avoided and a more even coat on the metal surface can be achieved. Methods for the electrostatic deposition of dry ceramic powders are disclosed in U.S. Pat. Nos. 3,928,668: 4,221,824, and 4,265,929 which are incorporated herein by reference.

Electrostatic application of such powders may be accomplished by means of electrical spray guns, regulation of voltage and current conditions, or any other known technique. The electrostatic spray gun which is the most commonly used means for application disperses charge coated ceramic powders as a cloud of particles which are directed by virtue of their charge and the output air pressure of the spray gun toward a grounded substrate. The substrate on which the deposition takes place is preferably electroconducting, e.g. a grounded metal substrate such as a steel panel. The substrate need not however be electroconducting. A grounded, electroconducting plate may, for example, be placed behind a non-electroconducting substrate to attract charged ceramic particles toward and onto the substrate. An electroconducting screen may also be placed before a non-electroconducting substrate to attract and direct charged ceramic particles through the screen and onto the substrate.

Methods for applying a charge to the ceramic particles are known to those skilled in the art. Methods for treating ceramic particles to promote retention of such charge are known. One such technique is disclosed in U.S. Pat. No. 3,928,668.

After the substrate has been coated with ceramic powder, it is fired by known and conventional processes to fuse the ceramic particles and provide a coating. Such firing is usually carried out at temperatures well above 900° F. (preferably above 1300° F.) at which organic materials such as mill oils and drawing compounds are pyrolyzed and burned.

In the process of the present invention, the dry powder is held in place by an electrostatic charge and remains a porous coating at 900° F. The products formed when the polybutene on the metal surface decomposes are driven off through the coating. Polybutenes depolymerize as they are heated and evaporate from the metal surface without leaving a carbon residue behind. Polybutenes are also excellent lubricants when used as drawing compounds.

The polybutenes present on the metal substrate to be coated also enhance adherence of the ceramic powder to the substrate in areas such as corners where the Faraday cage effect tends to hinder application of the powder.

The metal surface employed in the process of the present invention should not be badly rusted nor left in an area where dust can build up if they are to be effectively coated.

The invention is further illustrated but is not intended to be limited by the following examples in which all parts and percentages are by weight unless otherwise specified.

EXAMPLES

Boiler pans and backs for the oven of a stove were made in accordance with the procedure described below: The metal parts to be coated were cold rolled steel. The broiler pan blanks had a fairly deep draw and the oven back blanks had a 2⅛" draw with a sharp angle in it.

A light coating of the polybutene sold by Amoco Chemical Corp. under the designation Indopol L14 which had a viscosity of 27 to 33 centestoke at 38° C. was applied to the steel blanks by spraying. The blanks were then processed through the stamping and drawing operations to complete fabrication.

Without further processing, the fabricated parts were run through a powder application booth in which a porcelain enamel groundcoat powder was applied electrostatically. The powder was a conventional groundcoat having a composition within the following ranges:

| | Wt. % |
|---|---|
| $SiO_2$ | 40–45 |
| $B_2O_3$ | 15–19 |
| $Al_2O_3$ | 1–4 |
| $Na_2O$ | 7–10 |
| $K_2O$ | 3–7 |
| BaO | 2–7 |
| CaO | 2–7 |
| $TiO_2$ | 0–2 |
| F | 1–3 |
| CoO | 0–2 |
| NiO | 1–4 |
| $Fe_2O_3$ | 0–2 |
| $MnO_2$ | 0–4 |
| Other oxides | 0–5 |

The parts were then passed through a furnace where they were fired at 1460° F. The finished porcelain enamel coating was excellent in appearance and had no blemishes or blistering.

Even though the oven backs had a fairly deep corner (2⅛"), the enamel groundcoat powder adhered very well to the steel in those corners both before and after firing.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A process for coating a metallic surface with vitreous enamel in which a cleaning pre-treatment to remove surface oil from the metallic surface to be coated with the vitreous enamel is not required comprising:

(a) applying an enamel-forming material to a metallic surface coated with a polybutene as the surface oil; and (b) firing the thus-coated metal surface at a temperature sufficiently high to cause the enamel-forming material to form a vitreous enamel coating.

2. The process of claim 1 in which the metallic surface is steel.

3. The process of claim 2 in which the enamel-forming material is in the form of a powder and is applied by spraying.

4. The process of claim 1 in which the enamel-forming material is in the form of a powder and is applied by spraying.

5. The process of claim 1 in which the firing is carried out at a temperature of at least 1300° F.

6. The process of claim 1 in which the enamel-forming material is applied to the metallic surface by electrostatic deposition.

* * * * *